United States Patent [19]

Buske

[11] 4,448,270

[45] May 15, 1984

[54] VARIABLE DIAMETER EARTH BORING BIT

[75] Inventor: Robert J. Buske, Corsicana, Tex.

[73] Assignee: Hughes Tool Company, Houston, Tex.

[21] Appl. No.: 376,793

[22] Filed: May 10, 1982

[51] Int. Cl.[3] ..... E21B 10/20

[52] U.S. Cl. ..... 175/342; 175/384; 175/408; 175/412; 175/325

[58] Field of Search ..... 175/342, 53, 384, 325, 175/376; 408/239, 239 A; 279/103, 102; 409/233; 299/80; 285/332

[56] References Cited

U.S. PATENT DOCUMENTS

| | | | |
|---|---|---|---|
| 961,115 | 6/1910 | Fouts et al. | 175/384 X |
| 2,131,056 | 9/1938 | Lind | 279/103 |
| 3,231,029 | 1/1966 | Winberg | 175/53 |
| 3,460,867 | 8/1969 | Cameron et al. | 299/2 |
| 3,481,248 | 12/1969 | Engstrom | 408/239 A X |
| 3,486,412 | 12/1969 | Schraub et al. | 408/239 A X |
| 3,486,572 | 12/1969 | Hamilton et al. | 175/53 |
| 3,511,539 | 5/1970 | Schonfeld | 299/56 |
| 3,675,729 | 7/1972 | Neilson | 175/228 |
| 3,676,120 | 7/1972 | Nelson et al. | 408/239 X |
| 3,830,318 | 8/1974 | Busby et al. | 175/122 |
| 3,905,430 | 9/1975 | Poundstone | 175/53 |
| 3,917,009 | 11/1975 | Dyer et al. | 175/53 |
| 3,917,351 | 11/1975 | Pirrie et al. | 299/90 |
| 4,022,287 | 5/1977 | Lundstrom et al. | 285/332 X |
| 4,069,760 | 1/1978 | Eckels | 102/23 |
| 4,073,352 | 2/1978 | Underwood | 175/53 |

*Primary Examiner*—Ernest R. Purser
*Assistant Examiner*—Michael Starinsky
*Attorney, Agent, or Firm*—Robert A. Felsman; Charles D. Gunter, Jr.

[57] ABSTRACT

An earth boring bit is shown of the type used to cut a shaft in the earth. The earth boring bit has a central bit body which is adapted to be driven to cut a shaft and which has an outer conical surface thereon. An outer ring segment carried on the central bit body has a conical surface for matingly engaging the central bit body conical surface whereby torque transmitted to the outer ring is transmitted through the mating conical surfaces to drive the central bit body to cut a shaft. The mating conical surfaces are preloaded to assure drivable contact between the surfaces. The effective cutting diameter of the earth boring bit can be varied by interchanging the outer ring segment.

6 Claims, 3 Drawing Figures

VARIABLE DIAMETER EARTH BORING BIT

BACKGROUND OF THE INVENTION

The present invention relates generally to earth boring bits of the type used to cut a shaft in the earth, and specifically to large diameter earth boring bits of the type used in the mining and construction industries with variable effective cutting diameters to cut shafts of various sizes.

Large diameter earth boring bits are presently used in the mining and construction industries which vary in overall diameter from between about 2–3 feet to 20 feet or more in diameter. Typical prior art configurations for such bits included in a drill string, an intermediate mandrel connected at one end in the drill string and having an opposite end adapted to be connected to a drill bit body. In certain configurations, the mandrel opposite end was provided with a circular flange which matingly engaged the upper surface of the drill bit body. The bit body was provided with a plurality of roller cutting elements affixed by means of permanent mountings to the bottom surface of the bit body. A series of weights were often stacked above the mandrel flange to provide a load on the downwardly facing roller cutters carried on the bit body and one or more stabilizer structures were also often mounted above the bit body around the mandrel and/or about the bit body itself.

The driving torque for the cutting elements in such prior configurations was typically transmitted through the drill pipe, through the mandrel, and through the mandrel flange which was typically bolted to the upper surface of the bit body to cause rotation of the bit body and, in turn, rotation of the roller cutting elements.

While such arrangements were effective for cutting large diameter shafts many feet in diameter, the large diameter bits were extremely costly. Because the cutting elements were affixed by means of permanent mountings to the bit body, it was necessary to provide a separate bit for each different sized diameter hole or shaft which was to be cut.

There has existed a need, therefore, for a large diameter earth boring bit which could conveniently be expanded or contracted in size whereby the effective cutting diameter of the cutting elements could conveniently be increased or decreased without replacing the entire bit body.

SUMMARY OF THE INVENTION

The variable diameter earth boring bit of the present invention has a central body which is adapted to be driven for earth boring operations and which has an outer conical surface. An outer ring segment carried on the central body has a conical surface for matingly engaging the central body conical surface whereby torque transmitted to a selected one of the central body and outer ring segment is transmitted through the mating conical surfaces to drive the other of said central body and outer ring segment.

In shaft cutting operations, a central bit body has an upper surface, a lower surface, and a body portion therebetween. The body portion has an outer conical surface and the lower surface has at least one cutting element carried thereon adapted to be driven to cut a shaft. The outer ring section has an opening therein adapted to receive the central bit body. The outer ring segment is connectable in the drill string whereby torque transmitted to the drill string is transmitted to the outer ring segment. The outer ring segment has a conical surface in the interior of the central bit body receiving opening for matingly engaging the central bit body conical surface whereby torque transmitted to the outer ring is transmitted through the mating conical surfaces to drive the central bit body.

Pre-load means are provided for detachably engaging the outer ring segment to the central bit body to assure drivable contact between the mating conical surfaces. The effective cutting diameter of the earth boring bit can be varied by varying the diameter of the outer ring segment engaged on the central bit body.

Additional objects, features, and advantages will be apparent from the written description which follows.

DETAILED DESCRIPTION OF THE INVENTION

Figure 1:
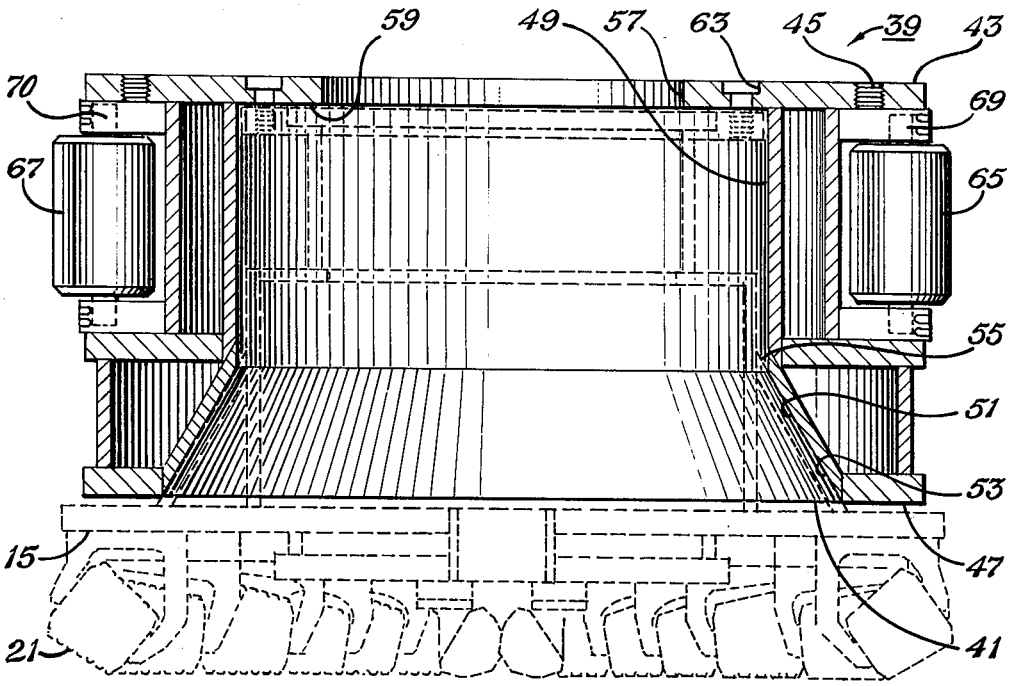
FIG. 1 is a side, partial cross-sectional view of the outer ring segment of the present invention.
Figure 2:
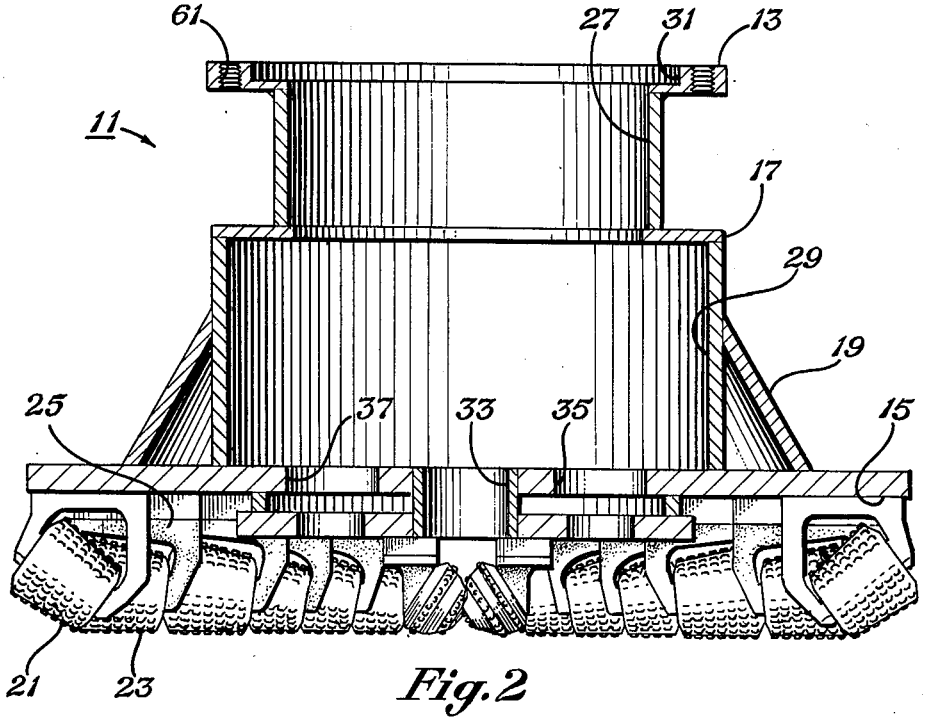
FIG. 2 is a side, partial cross-sectional view of the central bit body of the invention which is received within the outer ring segment of FIG. 1 as shown by the dotted lines in FIG. 1.

FIGS. 1 and 2 show an earth boring bit of the type used to cut a shaft in the earth. The earth boring bit is made up of a central bit body designated generally as 11 in FIG. 2 which is adapted to be driven to cut a shaft. Central bit body 11 has an upper surface 13, a lower surface 15, and a body portion 17 therebetween. The body portion 17 has an outer conical surface 19 thereon. At least one cutting element 21 is carried on lower surface 15 and is adapted to be driven to cut a shaft. Preferably, a plurality of cutting elements 23 are carried on lower surface 15 as by mounting cutting elements 23 in conventional yokes 25.

As shown in FIG. 2, body portion 17 of bit body 11 has a hollow interior forming upper and lower stepped cylindrical chambers 27, 29, respectively, which communicate by means of an opening 31 in upper surface 13 with the lower end of the drill string mandrel (not shown) when made-up in the conventional manner. A central opening 33 in lower surface 15 is provided for circulating drilling fluids, including air-liquid mixtures, which enter through opening 31, and pass out opening 33 and ports 35, 37 to contact the cutting elements 23, as for cooling the cutting elements and providing circulation of cut materials to the surface.

As shown in FIG. 1, the earth boring bit also includes an outer ring segment designated generally as 39 in FIG. 1 which has an opening 41 therein adapted to receive the central bit body 11 (shown in dotted lines in FIG. 1). The outer ring segment 39 is adapted to be connected in the drill string as by bolting the drill collar mandrel to the upper surface 43 of ring segment 39 using a series of circumferentially arranged threaded bores 45. The conventional drill collar mandrel, which is familiar to those skilled in the art, includes a longitudinal portion having an upper end which is threaded for connection in the drill string and a lower end having a circular flange containing a series of circumferential holes which correspond to the threaded bores 45 in upper surface 43 for receiving bolts. In this way, torque transmitted to the drill string is transmitted through the drill collar mandrel to the outer ring segment 39.

The interior of the outer ring segment 39 between the lower surface 47 and the upper surface 43 is divided into an upper generally cylindrical chamber 49 and a lower chamber 51. The sidewalls of lower chamber 51 are tapered to form a mating conical surface 53 for matingly engaging the central bit body conical surface (19 in FIG. 2 and shown as dotted lines 55 in FIG. 1).

The outer ring segment upper surface 43 has a central opening 57 adapted to communicate with the well string interior as previously described which also communicates with upper chamber 27 in central bit body 11 when bit body 11 is received within opening 41. The upper surface central opening 57 is of lesser relative internal diameter than the central bit body receiving opening 41 in lower surface 47 and is of lesser relative diameter than the internal diameter of the cylindrical sidewalls of upper chamber 49. As a result, upper surface 43 of ring segment 39 joins the cylindrical sidewalls of upper chamber 49 to form a circumferential lip 59 over chamber 49.

As best seen in FIG. 1, when central bit body 11 is received within opening 41 in outer ring segment 39, upper surface 13 of bit body 11 nearly contacts the circumferential lip 59 formed between central opening 57 and the cylindrical sidewalls of upper chamber 49. A series of circumferentially spaced threaded bores 61 in upper surface 13 are provided which mate with corresponding bolt receiving openings 63 in upper surface 43 of outer ring segment 39. Openings 63 and threaded bores 61 together comprise preload means for detachably engaging the outer ring segment 39 to the central bit body when engaged by bolts to thereby assure drivable contact between the mating conical surfaces 53, 19.

As shown in FIG. 1, outer ring segment 39 includes a pair of stabilizer roller assemblies 65, 67 mounted in bearings 69, 70. Such roller assemblies are known in the art and typically ride against the shaft internal diameter to centralize the bit body during drilling operations.

Figure 3:
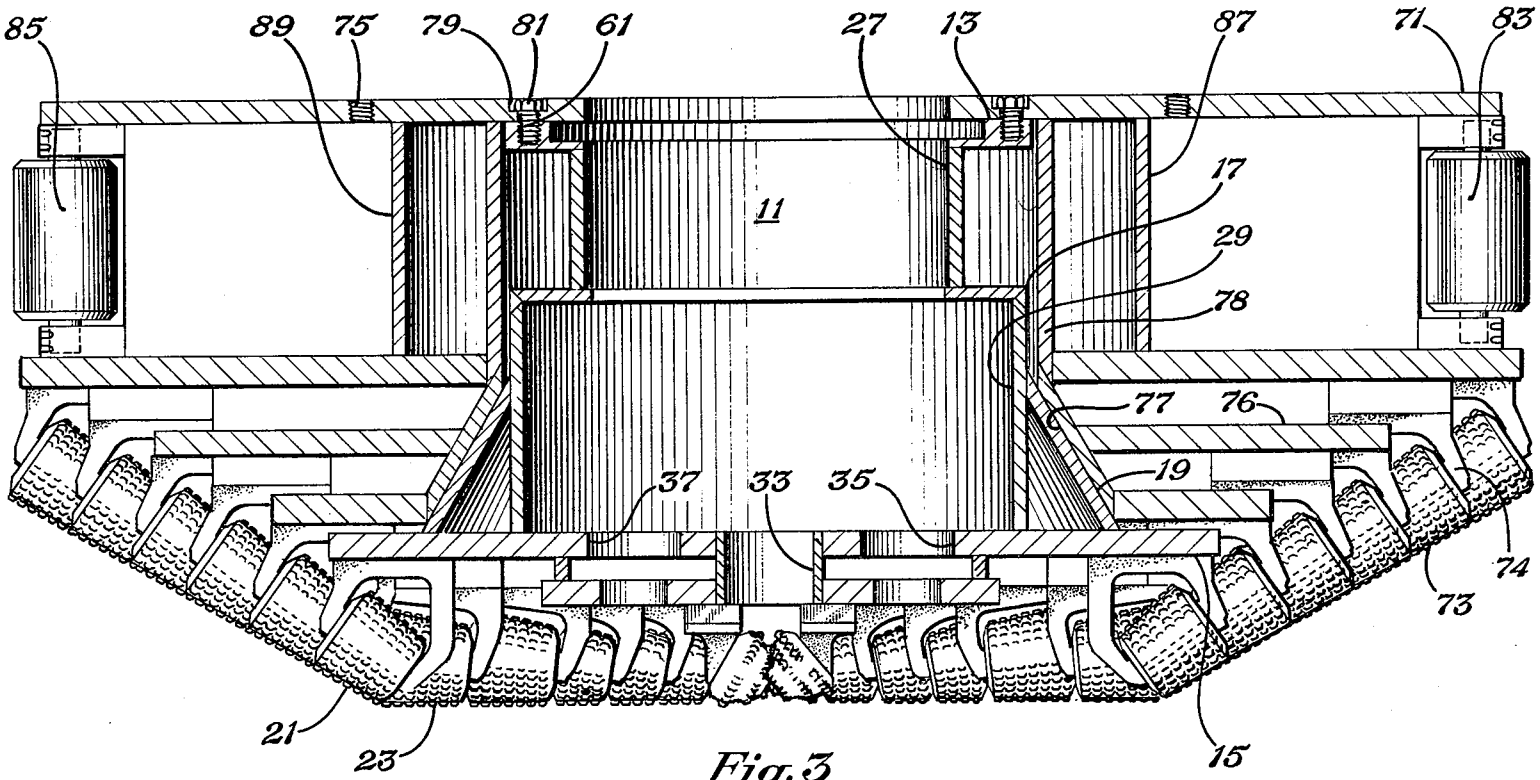
FIG. 3 is a side, partial cross-sectional view of an outer ring segment similar to FIG. 1 but of greater diameter with the central bit body of FIG. 2 received therein.

FIG. 3 shows a variable diameter earth boring bit of the present invention which has a central bit body 11 including an upper surface 13, a lower surface 15, and a body portion 17 identical to that shown in FIG. 2. The central bit body also has a series of cutting elements 23 adapted to be driven to cut a shaft. The earth boring bit shown in FIG. 3 differs from the earth boring bit of FIGS. 1 and 2 in that the outer ring segment 71 is of greater diameter and includes a series of cutting elements 73 carried thereon as by yokes 74. Outer ring segment 71 has threaded bore 75 identical to threaded bores 45 shown in FIG. 1 for connecting the outer ring segment 71 to a drill collar mandrel in a drill string whereby torque transmitted to the drill string is transmitted to the outer ring segment 71. Outer ring segment 71 also has a conical interior surface 77 and a cylindrical body portion 78. As shown in FIG. 3, yokes 74 are carried by a series of stepped ledges 76 which are welded to conical surface 77 and body portion 78, respectively. Conical interior surface 77 of ring segment 71 is provided for matingly engaging the central bit body conical surface 19 whereby torque transmitted to the outer ring segment 71 is transmitted through the mating conical surfaces 19, 77 to drive the central bit body to cut a shaft in the earth. Bolt receiving openings 79 in outer ring segment 71 are provided which correspond to threaded bores 61 in upper surface 13 of bit body 11. When bolts 81 are placed within openings 79 and threadedly engage bores 61, they comprise preload means for detachably engaging the outer ring segment 71 to the central bit body 11 to assure drivable contact between the mating conical surfaces 19, 77. Outer ring segment 71 can also include stabilizer roller assemblies 83, 85 similar to assemblies 65, 67 shown in FIG. 1 and supported on the outer ring segment by web structures 87, 89.

The operation of the present invention will now be described. The earth boring bit of the present invention can be made up as shown in FIGS. 1 and 2 by placing the outer ring segment 39 over the central bit body 11 with the upper surface 13 of bit body 11 being received within the opening 41 in outer ring segment 39. The outer ring segment 39 is lowered over the central bit body 11. The mating conical surfaces 19, 53 are brought into contact after which upper surface 13 nearly contacts circumferential lip 59. The threaded bores 61 in upper surface 13 are aligned with bolt receiving openings 63 in outer ring segment 39 and bolts are inserted in openings 63 and tightened into place. As the bolts are tightened into place, conical surfaces 19, 53 are preloaded, thereby assuring frictional contact between the two surfaces. The earth boring bit assembly can then be run in a conventional drill string by bolting the upper surface 43 of the outer ring segment 39 to the circumferential flange of a conventional drill collar mandrel which is in turn made up in the drill string. Torque transmitted to the drill string is then transmitted through the drill collar mandrel and through the bolts in bores 45 to the outer ring segment 39. Torque transmitted to ring segment 39 is in turn transmitted through the mating conical surfaces 19, 53 to the central bit body 11 thereby driving the bit body to effect cutting action of the cutting elements 23 carried on lower surface 15.

As shown in FIG. 3, the earth boring bit of the present invention can easily be expanded or contracted to accommodate a variety of drilling situations by detachably engaging outer ring segments such as 71 to vary the effective cutting diameter of the bit. The outer ring segment 71 in FIG. 3 includes a series of additional cutting elements 73 carried thereon which cooperate with the cutting elements 23 carried on the lower surface 15 of central bit body 11 to provide a greater effective cutting area to cut a larger diameter shaft. Other outer ring segments identical in design to ring segment 71 could be provided of larger, smaller or intermediate cutting diameters.

An invention has been provided with significant advantages. The earth boring bit of the invention is made up of a central bit body and interchangeable outer ring segments of varying diameter. By using the mating conical surfaces on the central bit body and in the interior of the outer ring segment, torque can be transmitted through interchangeable ring segments to the same central bit body. In this way, the user can buy one central bit body which can be used with a series of outer ring segments to drill a number of shafts of varying diameter. Depending upon the particular drilling requirement, the cutting diameter can be varied to increase or decrease the diameter without the necessity of buying a complete new bit body or welding and torching off additional cutting elements. Since the central bit body 11 is the most expensive part of the assembly, cost savings will result.

While the invention has been shown in only one of its forms, it will be appreciated that it is not thus limited but is susceptible to various changes and modifications without departing from the spirit thereof.

I claim:

1. An earth boring bit adapted to be connected in a drill string for cutting a shaft in the earth, comprising:

a central bit body which is adapted to be driven to cut a shaft, said central bit body having an outer conical surface thereon and a hollow interior for circulating drilling fluids; and an outer ring segment carried on said central bit body, said outer ring segment being connectable in said drill string whereby torque transmitted to said drill string is transmitted to said outer ring segment, and said outer ring segment having a conical surface for matingly engaging said central bit body conical surface, and pre-load means for detachably engaging said outer ring segment to said central bit body to assure drivable contact between said mating conical surfaces whereby torque transmitted to said outer ring segment is transmitted through said mating conical surfaces to drive said central bit body to cut a shaft in the earth.

2. An earth boring bit adapted to be connected in a drill string for cutting a shaft in the earth, comprising:

a central bit body having an upper surface, a lower surface, and a body portion therebetween, said body portion having an outer conical surface thereon and a hollow interior for circulating drilling fluids, and said lower surface having at least one cutting element carried thereon adapted to be driven to cut a shaft; and an outer ring segment having an opening therein adapted to receive said central bit body, said outer ring segment being connectable in said drill string whereby torque transmitted to said drill string is transmitted to said outer ring segment, and said outer ring segment having a conical surface in the interior of said central bit body receiving opening for matingly engaging said central bit body conical surface, and pre-load means for detachably engaging said outer ring segment to said central bit body to assure drivable contact between said mating conical surfaces whereby torque transmitted to said outer ring segment is transmitted through said mating conical surfaces to drive said central bit body to cut a shaft in the earth.

3. A variable diameter earth boring bit adapted to be connected in a drill string for cutting a shaft in the earth, comprising:

a central bit body having an upper surface, a lower surface, and a body portion therebetween which is adapted to be driven to cut a shaft, said central bit body having an outer conical surface thereon, a hollow interior for circulating drilling fluids, and at least one cutting element carried on said lower surface;

an outer ring segment carried on said central bit body, said outer ring segment being connectable in said drill string whereby torque transmitted to said drill string is transmitted to said outer ring segment, and said outer ring segment having a conical surface for matingly engaging said central bit body conical surface whereby torque transmitted to said outer ring segment is transmitted through said mating conical surfaces to drive said central bit body to cut a shaft in the earth, said outer ring segment having at least one cutting element carried about the circumference thereof; and pre-load means for detachably engaging said outer ring segment to said central bit body to assure drivable contact between said mating conical surfaces and whereby the effective cutting diameter of said earth boring bit can be varied by varying the diameter of the outer ring segment engaged on said central bit body.

4. The variable diameter bit of claim 3, wherein said outer ring segment has an upper surface adapted to be connected in said drill string and a lower surface with a central bit body receiving opening therein, the interior of said outer ring between said opening in said lower surface and said upper surface being divided into an upper chamber with generally cylindrical sidewalls and a lower chamber with sidewalls tapered to form a mating conical surface for matingly engaging said central bit body conical surface.

5. A variable diameter earth boring bit adapted to be connected in a drill string for cutting a shaft in the earth, comprising:

a central bit body having an upper surface, a lower surface, and a body portion therebetween which is adapted to be driven to cut a shaft, said central bit body having an outer conical surface thereon and at least one cutting element carried on said lower surface;

an outer ring segment carried on said central bit body, having at least one cutting element carried about the circumference thereof, a lower surface with a central bit body receiving opening, a lower chamber with sidewalls tapered to form a mating conical surface for matingly engaging said central bit body conical surface whereby torque transmitted to said outer ring segment is transmitted through said mating conical surfaces to drive said central bit body to cut a shaft in the earth, an upper chamber with generally cylindrical sidewalls, and an upper surface adapted to be connected in said drill string whereby torque transmitted to said drill string is transmitted to said outer ring segment, said outer ring upper surface having an opening therein adapted to communicate with said drill string interior, said upper surface opening being of lesser relative internal diameter than said central bit body receiving opening and of lesser relative diameter than the internal diameter of said upper chamber cylindrical sidewalls, said upper surface joining said upper chamber sidewalls to form a circumferential lip over said upper chamber; and pre-load means for detachably engaging said outer ring segment to said central bit body to assure drivable contact between said mating conical surfaces and whereby the effective cutting diameter of said earth boring bit can be varied by varying the diameter of the outer ring segment engaged on said central bit body.

6. The variable diameter bit body of claim 5, wherein said body portion of said central bit body has an outer conical surface thereon, said body upper surface contacting said circumferential lip when said central bit body is received within said central bit body receiving opening; and wherein said pre-load means detachably engages said central bit body upper surface and said outer ring circumferential lip.

* * * * *